United States Patent [19]

Scruggs

[11] 4,158,342

[45] Jun. 19, 1979

[54] SCORING DEVICE

[76] Inventor: Jack E. Scruggs, 3412 Brainerd Rd., Chattanooga, Tenn. 37411

[21] Appl. No.: 936,740

[22] Filed: Aug. 25, 1978

[51] Int. Cl.[2] ..... A63B 71/06

[52] U.S. Cl. ..... 116/225; 116/223; 273/DIG. 26

[58] Field of Search ..... 116/120, 114 R, 114 AJ, 116/130, 133, 135; 24/204; 2/170; 40/70 R; 235/1 B, 65, 66, 71 R, 78 G, 125; 273/29 R, 73 R, DIG. 26

[56] References Cited

U.S. PATENT DOCUMENTS

| | | | |
|---|---|---|---|
| 3,635,190 | 1/1972 | Araki | 116/120 |
| 3,777,699 | 12/1973 | Pfleger | 116/120 |
| 3,936,963 | 2/1976 | Chan | 116/120 X |
| 3,986,715 | 10/1976 | Glick | 116/120 X |
| 4,065,834 | 1/1978 | Montague | 24/204 |

FOREIGN PATENT DOCUMENTS

| | | | |
|---|---|---|---|
| 1371485 | 10/1974 | United Kingdom | 116/120 |

*Primary Examiner*—Donald Watkins
*Attorney, Agent, or Firm*—Lamont Johnston

[57] ABSTRACT

A scoring device is provided for sports events. The scoring device is comprised of a wrist band of flexible material and a securing means for securing the band snugly about wrists of different sizes. The scoring device is further comprised of a plurality of scoring characters arranged on the wrist band and at least one scoring marker. The marker has attached to at least one side an attachment means for detachably attaching the scoring marker to the wrist band in close proximity to a scoring character. When it is desired to record the score of the sports event the scoring marker is attached to the wrist band in close proximity to the appropriate scoring character.

10 Claims, 4 Drawing Figures

FIG. 1
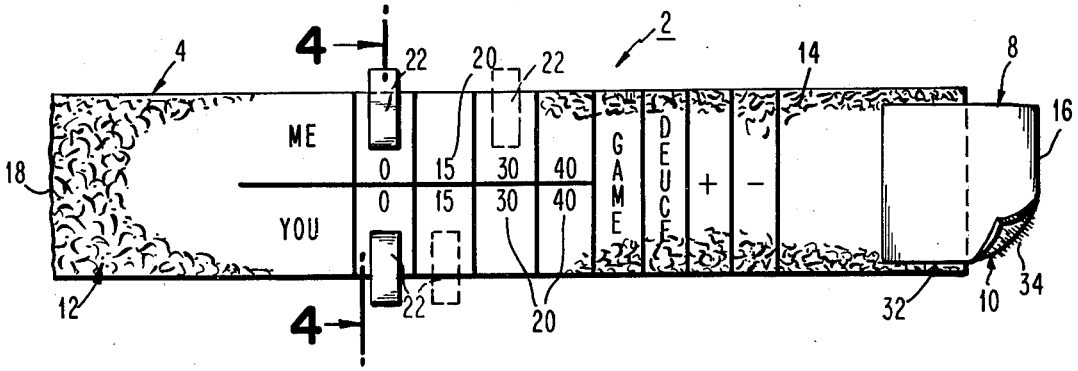
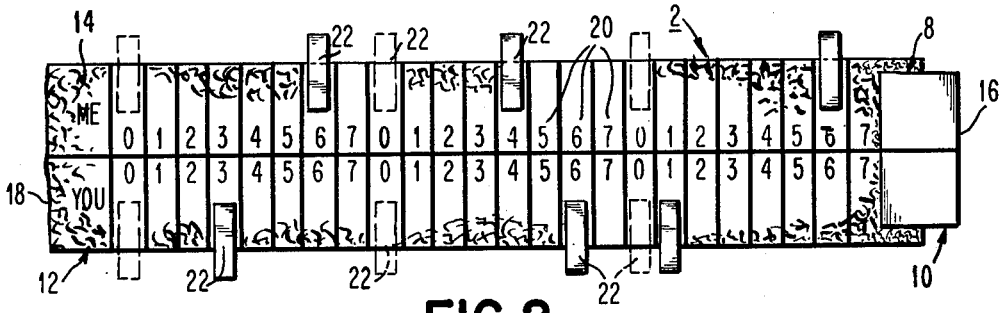
FIG. 2
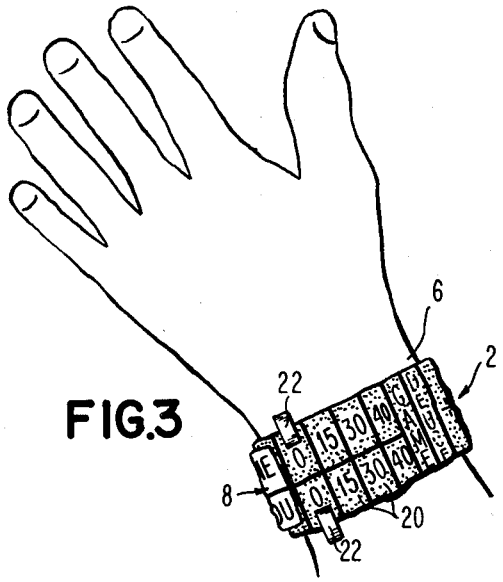
FIG. 3
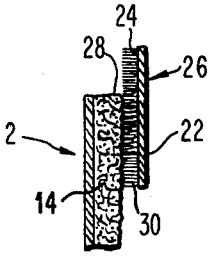
FIG. 4

SCORING DEVICE

BACKGROUND OF THE INVENTION

1. Field of the Invention

This invention relates to a scoring device for sports events, and more particularly relates to a scoring device for use in the game of tennis.

Scoring for the game of tennis is quite different from scoring in golf, baseball, bowling, football and other sporting events. In the typical sports event the scoring is usually additive. In the game of tennis, however, scoring is additive and subtractive and involves totalizing game scores which result from an accumulation of a given number of point scores. The sequence of point scoring consists of "love" (which is zero) "15", "30", "40", "ADD", in particular "ADD IN" (ball server's advantage) and ADD OUT (ball receiver's advantage), and "GAME". A "40—40" tie score is normally termed "DEUCE". Thus, the scoring of the game can be both additive or subtractive. The addition of two consecutive points past the 40—40 score results in the winning of the game.

The game score must also be scored. The first team to win six games is the winner of a set, but the team must win by two games to win the set. For example, if a set goes to a six-six tie in games, the set is played until two games more than the other side are won by one team. Additionally, it is not uncommon for a match to go to the winner of, for example, two out of three sets.

Thus, as can be seen from the foregoing, keeping score in the game of tennis can be complicated, particularly for the novice tennis player.

2. Prior Art

While tennis scoring devices and wrist worn scoring devices are known, such devices generally use complicated mechanisms in which knobs or buttons are used to activate a series of gears which in turn operate indicators. Most of these mechanisms are relatively complicated to manufacture, are not particularly durable and, because of their complexity, may not be manufactured cheaply enough to be put into widespread use.

Additionally, other type scoring devices used for other type sporting events are not suitable for the relatively complicated manner of scoring tennis.

Several prior art scoring devices are exemplified by the following U.S. Pat. Nos.: 753,457; 3,635,190; 3,777,699; 3,847,110; 3,936,963; 3,986,715; and 4,069,954.

Of these aforementioned U.S. Pat. Nos., 3,777,699, 3,936,963 and 3,986,715 relate to scoring devices used in the game of tennis.

SUMMARY OF THE INVENTION

The aforementioned and other disadvantages of the prior art scoring devices are overcome by the present invention of a scoring device for sports events, particularly tennis, which records both (a) the number of points scored by each team in a game of tennis and (b) the number of games scored by each team in a set of games. The scoring device comprises:

A wrist band of flexible material;

A securing means for securing the band snugly about wrists of different sizes;

A plurality of scoring characters arranged on the wrist band; and

At least one scoring marker, the marker having attached to at least one side an attachment means for detachably attaching the scoring marker to the wrist band in close proximity to a scoring character.

When it is desired to record the score of the sports event the scoring marker is attached to the wrist band in close proximity to the appropriate scoring character.

It can thus be seen that the scoring device of this invention is relatively simple to construct and is both inexpensive and reliable.

It is therefore an object of the present invention to provide a wrist worn device for recording both the number of points scored by each of two teams in a game of tennis and the number of games scored by each team in a set of games.

It is another object of this invention to provide a scoring device which is capable of registering the game scores and point scores for the game of tennis.

It is another object of this invention to provide a scoring device for the game of tennis that is small enough so that the device can be worn on the wrist of a player.

It is another object of this invention to provide a scoring device for the game of tennis which not only is small in size, but is light in weight.

It is another object of this invention to provide a scoring device for the game of tennis which is simple to operate and easy to read.

It is another object of this invention to provide a scoring device for the game of tennis which is simple in structure, reliable and reasonable in cost to manufacture.

Other features and objects of the invention will become apparent by reference to the following specification and to the drawings.

BRIEF DESCRIPTION OF THE DRAWINGS

FIG. 1 is a plan view of the scoring device wherein the scoring characters are arranged and sequenced for point scoring tennis for two teams;

FIG. 2 is a plan view of the scoring device wherein the scoring characters are arranged and sequenced for game scoring tennis for two teams;

FIG. 3 is a perspective view of the scoring device when placed on a wrist; and

FIG. 4 is a fragmentary cross-sectional view taken along line 4-4 of FIG. 1 of a scoring band and a scoring marker being attached to the band.

DETAILED DESCRIPTION OF THE INVENTION

Referring to the drawings in detail, the scoring device (2) of this invention may be used for any sporting event scoring. It is particularly preferred that the scoring device (2) be used for point scoring and game scoring tennis.

The device (2) is comprised of a wrist band (4) made of a material of sufficient flexibility to wrap around a wrist (6). The scoring device (2) is provided with a securing means (8) for securing the band (4) snugly about wrists (6) of different sizes. Preferably, the securing means (8) consists of cooperating areas (10 and 12) of hooked pile fabric (14) at opposite ends (16 and 18) of the band (4).

It should be understood that in the present disclosure the term "hooked pile fabric" is used to describe, for example, both cooperating areas (10 and 12), even though they are not made of identical material. For example, the "pile" of cooperating area (10) may consist of relatively rigid platic hooks which engage the fabric pile of cooperating area (12). This structure permits the user to lap the end (16) over the end (18) far enough to cause the wrist band (4) to fit snugly about the wrist (6). Suitable cooperating hook pile fabrics are commercially available under the trademark VELCRO.

Although cooperating areas (10 and 12) of hooked pile fabric are preferred, one may use snaps, buttons, buckles, etc. as the securing means.

A plurality of scoring characters (2) are arranged on the wrist band (4). Generally, the type scoring characters (20) on the wrist band (4) are determined by the sports event to be scored. Preferably, the scoring device (2) is used to score tennis. It is thus preferred that the scoring characters (20) are arranged and sequenced for point scoring tennis (FIG. 1) and/or game scoring tennis (FIG. 2). Preferably, the scoring characters (20) are arranged for point scoring and/or game scoring for two teams. By the use of the term "team" it is meant to include both one and two players on a team.

A preferred arrangement and sequence of scoring characters (20) for point scoring tennis for two teams is depicted in FIG. 1.

A preferred arrangement and sequence of scoring characters (20) for game scoring tennis for two teams is depicted in FIG. 2.

The scoring device (2) is further comprised of at least one scoring marker (22). The marker (22) has attached to at least one side (24) an attachment means (26) for detachably attaching the scoring marker (22) to the wrist band (4) in close proximity to the scoring character (20). By the use of the term "close proximity" it is meant to include placement of the marker (22) so that the appropriate score is indicated, which may include, for example, placement of the marker (22) offset from or directly upon the scoring character (20).

Preferably, the scoring characters (20) for point scoring tennis for two teams (as depicted in FIG. 1) should have two scoring markers; whereas the scoring characters (20) for game scoring tennis for two teams (as depicted in FIG. 2) should have six scoring markers (22), i.e. two scoring markers (22) for each set of scoring characters (20) for game scoring a set of tennis.

The attachment means (26) of the scoring marker (22) can be any commonly used attachment device, i.e. snaps, magnets, etc. It is particularly preferred, however, that the scoring characters (20) and attachment means (26) consist of cooperating areas (28 and 30) of hooked pile fabric, such as that sold under the trademark "VELCRO". This is depicted in cross-section in FIG. 4.

A particularly preferred construction of the scoring device (2) is wherein the upper surface (32) of the wrist band (4), the lower surface (34) of the securing means (8) and the attachment means (26), all consist of cooperating hooked pile fabric.

In use the wrist band (4) is secured about the wrist (6). If tennis is being scored, one team member may point score, i.e. use the scoring device (2) of FIG. 1 and a member from the other team may game score, i.e. use the scoring device (2) of FIG. 2. Optionally, both point scoring and game scoring may be done by one person, either using one scoring device to perform both functions (an embodiment of scoring characters not depicted), or two separate scoring devices. When it is desired to record the score, the scoring marker (22) is attached to the wrist band (4) in close proximity to the appropriate scoring character (20). Optionally, the wrist band (4) by its color may indicate the level of skill in playing of the player. The wrist band (4) may also be worn comfortably over a wrist sweat band.

While several embodiments of the invention have been described in detail, it will be apparent to those skilled in the art that the disclosed embodiments may be modified. Therefore, the foregoing description is to be considered exemplary rather than limiting, and the true scope of the invention is that defined in the following claims.

What is claimed is:

1. A scoring device for sports events comprising:

A wrist band of flexible material;

A securing means for securing the band snugly about wrists of different sizes;

A plurality of scoring characters arranged on the wrist band; and at least one scoring marker, the marker having attached to at least one side an attachment means for detachably attaching the scoring marker to the wrist band in close proximity to a scoring character;

Whereby when it is desired to record the score of the sports event the scoring marker is attached to the wrist band in close proximity to the appropriate scoring character.

2. The scoring device of claim 1, wherein the securing means consists of cooperating areas of hooked pile fabric at opposite ends of the band.

3. The scoring device of claim 1, wherein the scoring characters and attachment means consists of cooperating areas of hooked pile fabric.

4. The scoring device of claim 1, wherein: (a) the upper surface of the band and lower surface of the securing means; and (b) the upper surface of the band and the lower surface of the attachment means, both consist of cooperating hooked pile fabric.

5. The scoring device of claim 1, wherein the scoring characters are arranged and sequenced for point scoring the sports event of tennis.

6. The scoring device of claim 5, wherein the scoring characters are for point scoring for two teams.

7. The scoring device of claim 6, wherein there are two scoring markers.

8. The scoring device of claim 1, wherein the scoring characters are arranged and sequenced for game scoring the sports event of tennis.

9. The scoring device of claim 8, wherein the scoring characters are for game scoring for two teams.

10. The scoring device of claim 9, wherein there are two scoring markers for each set of scoring characters for game scoring a set of tennis.

* * * * *